United States Patent [19]

Dippel

[11] Patent Number: 4,872,684

[45] Date of Patent: Oct. 10, 1989

[54] GOLF PUTTER

[76] Inventor: Stephanie A. Dippel, 8787 E. Mountain View #2010, Scottsdale, Ariz. 85258

[21] Appl. No.: 289,610

[22] Filed: Dec. 23, 1988

Related U.S. Application Data

[63] Continuation-in-part of Ser. No. 115,413, Nov. 2, 1987.

[51] Int. Cl.[4] ..... A63B 53/04

[52] U.S. Cl. ..... 273/164; 273/167 C; 273/171; 273/DIG. 11; 273/167 B

[58] Field of Search ..... 273/167 C, 171, 167 B, 273/174, 175, 164, DIG. 6, DIG. 11, 167 A, 167 R, 167 F, 167 H, 168, 78

[56] References Cited

U.S. PATENT DOCUMENTS

| | | | |
|---|---|---|---|
| 1,525,137 | 2/1925 | Lawton | 273/167 C |
| 2,486,952 | 11/1949 | Kearsley et al. | 273/174 |
| 2,542,081 | 2/1951 | Hockey | 273/167 C |
| 2,665,909 | 1/1954 | Wilson | 273/175 |
| 4,508,342 | 4/1985 | Drake | 273/167 C |
| 4,519,612 | 5/1985 | Tsao | 273/167 A |
| 4,607,846 | 8/1986 | Perkins | 273/171 |
| 4,614,627 | 9/1986 | Curtis et al. | 273/167 H |

FOREIGN PATENT DOCUMENTS

| | | | |
|---|---|---|---|
| 1008972 | 11/1965 | United Kingdom | 273/167 C |
| 1470768 | 4/1977 | United Kingdom | 273/171 |

OTHER PUBLICATIONS

"Encyclopedia of Polymer Science Technology", vol. 13, p. 422, 1970 Edition.

"Golf Digest", p. 78, Aug. 1977.

"Golf Digest", p. 77, Jul. 1971.

*Primary Examiner*—George J. Marlo

*Attorney, Agent, or Firm*—Charles E. Cates; James H. Phillips; Richard G. Harrer

[57] ABSTRACT

A golf putter has a substantially cylindrical club head made from a tough, resilient, non-metallic plastic material such as acetal polymer (e.g., Delrin or Celcon); has weight-receiving receptacles recessed in each of the heel and toe ends; and weight inserts within the weight-receiving receptacles. The diameter of the cylindrical club head, e.g., one and one-quarter inches, is smaller than the diameter of a ball to be played. A visual alignment mark extends circumferentially partially around the cylindrical body at a position equidistant between the heel and toe ends and thus, just toward the toe end from the position at which a conventional shaft is coupled to the club head.

20 Claims, 2 Drawing Sheets

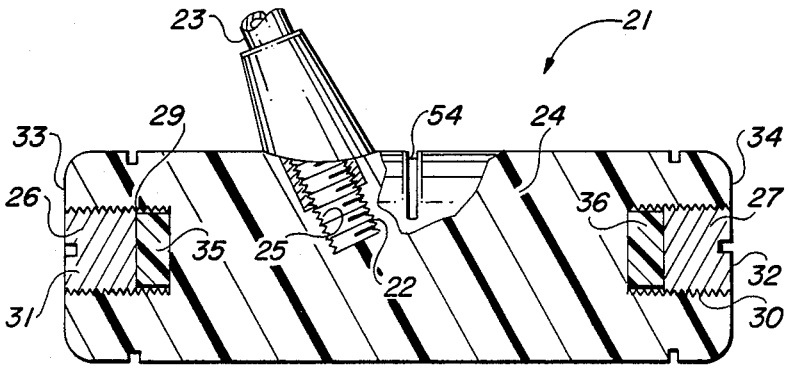
FIG. 5
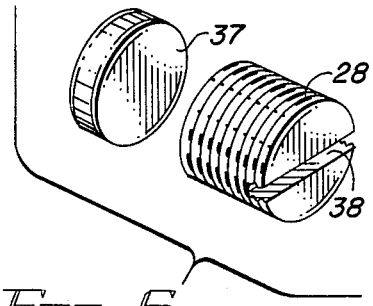
FIG. 6
FIG. 7
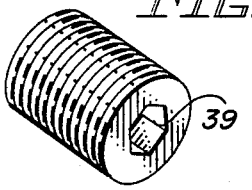
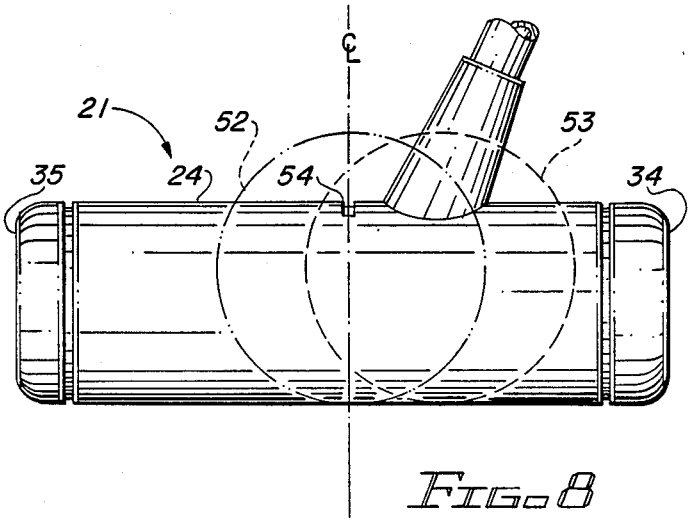
FIG. 8
FIG. 9
(PRIOR ART)
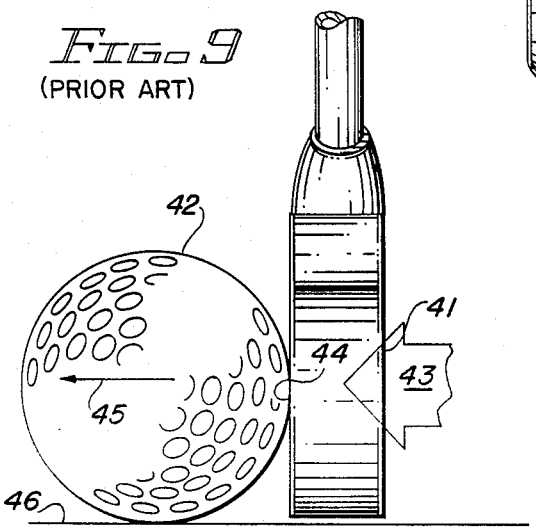
FIG. 10
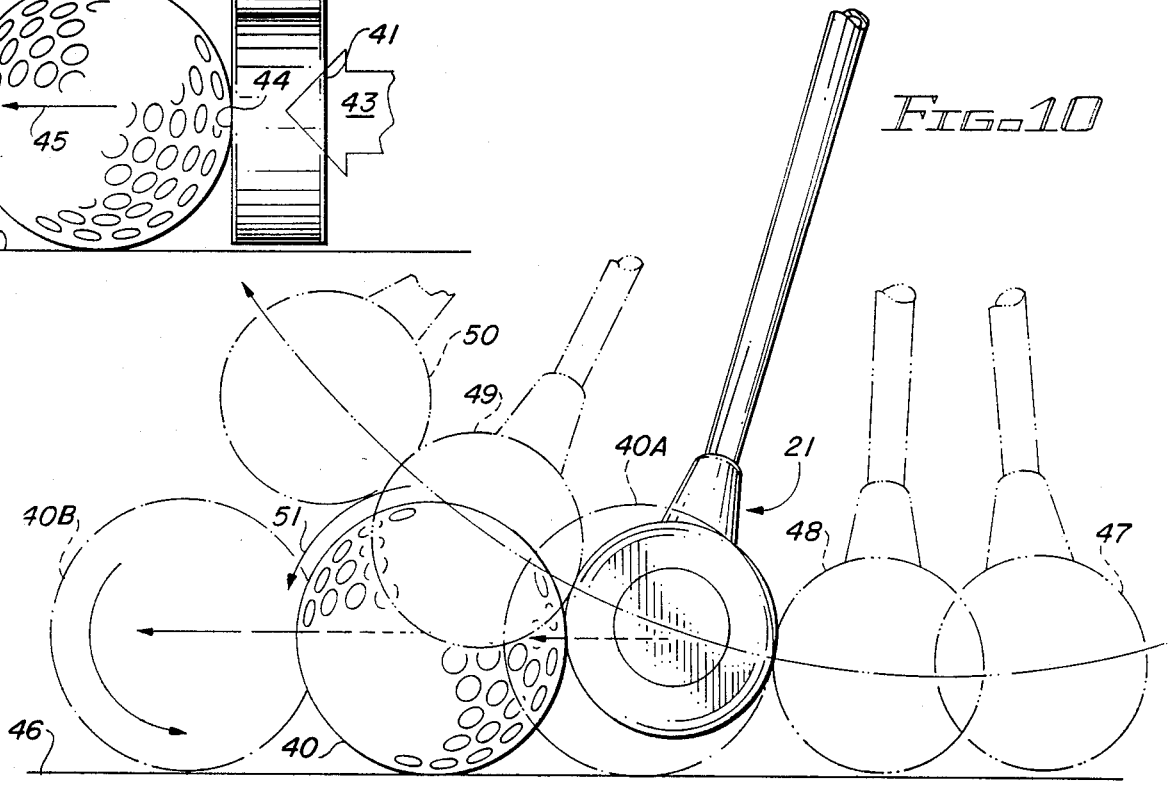

GOLF PUTTER

RELATED CASES

This is a continuation-in-part of co-pending U.S. application Ser. No. 115,413, filed Nov. 2, 1987.

FIELD OF THE INVENTION

This invention relates to the game of golf, particularly to golf putters.

BACKGROUND OF THE INVENTION

Golfers, whether professional or amateur, all appreciate that one difficult aspect of the game of golf is the use of a putter which is typically employed on the green to propel a golf ball toward the target cup along the green surface. A typical putter is characterized by a ball-engaging face which is substantially upright at the instant when the stroke of the putter results in striking the ball. If the ball is reasonably squarely struck, the impulse is conveyed to the ball in such a manner that it can be represented by a generally horizontal line passing through or very near the center of the ball. As a result, and as is notoriously well-known by golfers, there is a natural tendency for the ball to initially simply slide along the surface of the green, gradually picking up forward rotation as result of frictional engagement between the surface of the ball and the green. For short putts, as when the ball lies near the cup, forward spin often has no chance to fully develop.

Golfers appreciate that a ball putted with initial slide is subject to slight, but not insubstantial, deviations from the desired path resulting from traversing minor imperfections in the green surface or even as a result of slight imperfections of the ball. These deviations are often sufficient to cause a surprisingly missed putt and are thus a source of frustration to the golfer, particularly one with sufficient skill that the putt would otherwise have been made. Further, if the ball has not picked up a full complement of forward spin by the time it reaches the cup, it will have less tendency to, in effect, pull itself into the cup as it engages the cup lip.

Thus, it will be appreciated that it would be highly desirable to provide a putter which imparts immediate forward spin on a golf ball as a consequence of the putting stroke in order to improve the accuracy of the path traversed from the lie of the ball toward the cup. Such immediate forward spin, if it can be imparted, would overcome the tendency of the ball, during the initial portion of its traverse, to deviate from the desired path as a result of slide. Further, there would be a not inconsequential gyroscopic effect which would further stabilize the course of the ball during the initial portion of its travel. For short putts, the deliberately imparted forward spin would also aid in pulling the ball into the cup.

Other problems associated with the use of conventional putters is the tendency of the putter to slightly pivot horizontally if the ball is not struck more or less in line with the center of gravity of the club head. As a result, the initial path of the ball deviates to the left or right of the intended path by a slight amount which, however, is not inconsequential and, again, results in unsatisfactory performance.

Another consideration to be dealt with is the material from which the head is made, the selection of which can affect the performance characteristics of the club.

It is to the solution of the problems associated with the initial sliding action of a ball immediately after a putting stroke and the effect of stroking the ball slightly off the center of gravity of the putter head that my invention is directed.

OBJECTS OF THE INVENTION

It is therefore a broad object of my invention to provide an improved golf putter.

It is another object of my invention to provide a golf putter which imparts immediate forward spin to a struck ball as a consequence of the normal putting stroke.

In another aspect, it is an object of my invention to provide such an improved golf putter which also is very stable during the putting stroke and is relatively insensitive to stroking the ball slightly to one side of the center of gravity of the putter head.

In yet another aspect, it is an object of my invention to provide a putter having improved performance.

It is also an object of my invention to provide such a golf putter which can be customized to the individual characteristics and preferences of a particular golfer.

SUMMARY OF THE INVENTION

Briefly, these and other objects of my invention are achieved by a golf putter particularly characterized by the incorporation of a generally cylindrical club head. The club head includes a main body portion fabricated from a tough, resilient plastic material, such as Delrin, Celcon, Teflon or Nylon (all registered trademarks) and which has weight-receiving receptacles recessed in each of the heel and toe ends. Weight inserts, which may be selected according to the preferences and characteristics of an individual golfer, are emplaced within the weight-receiving receptacles by interference fit, adhesive, threaded engagement or the like. Preferably, the diameter of the cylindrical club head is smaller than the diameter of a standard golf ball and, in one presently preferred embodiment, is about one and one-quarter inches. To further aide the golfer, a visual alignment mark extends circumferentially partially around the cylindrical body at a position equidistant between the heel and toe ends and thus, just toward the toe end from the position at which a conventional shaft is coupled to the club head.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 5 is a cross sectional view similar to FIG. 3 illustrating a variant configuration for the weight components of my putter and the manner in which they may be incorporated into my putter and also illustrating a variant method for coupling the shaft to the club head;

FIG. 6 illustrates the relationship between spacer and weight insert components which may be employed in the variant embodiment of my putter illustrated in FIG. 5;

FIG. 7 illustrates another configuration for a weight insert component which may be employed in the embodiment of my putter illustrated in FIG. 5;

FIG. 8 is a view of the ball-striking region of my putter illustrating the respective effects of stroking a ball squarely in line with the club head center of gravity in comparison with a ball struck slightly eccentrically;

FIG. 9 illustrates the immediate effect of stroking a golf ball with a typical prior art putter; and FIG. 10 illustrates the effect of stroking a golf ball with my putter and particularly showing the manner in which forward spin is immediately imparted to the ball.

DETAILED DESCRIPTION OF THE INVENTION

Figure 1:
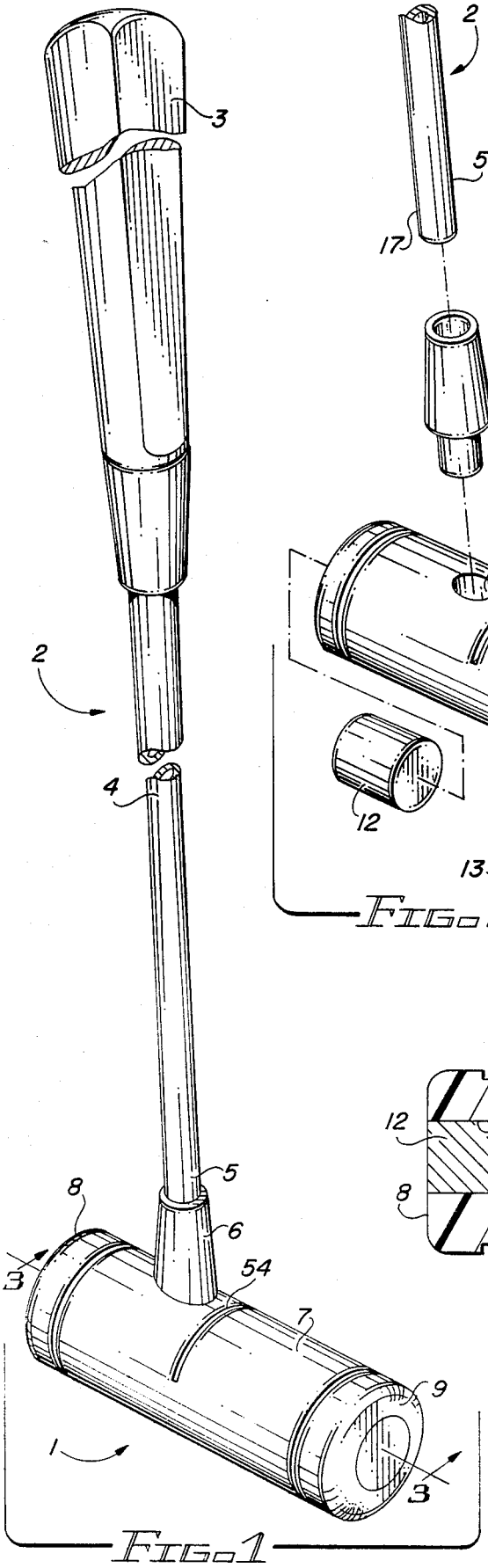
FIG. 1 is a partially broken away perspective view from the right front of a putter according to my invention.

Referring now to FIG. 1, there is shown a partially broken away perspective view of a putter in accordance with my invention. The putter includes a special purpose club head 1 and a substantially conventional shaft 2 which includes a grip end 3, an elongated intermediate section 4 and a club head end 5 which may optionally include a ferrule 6. The club head 1 is generally cylindrical and includes a main body 7 having a heel end 8 and a toe end 9.

Figure 2:
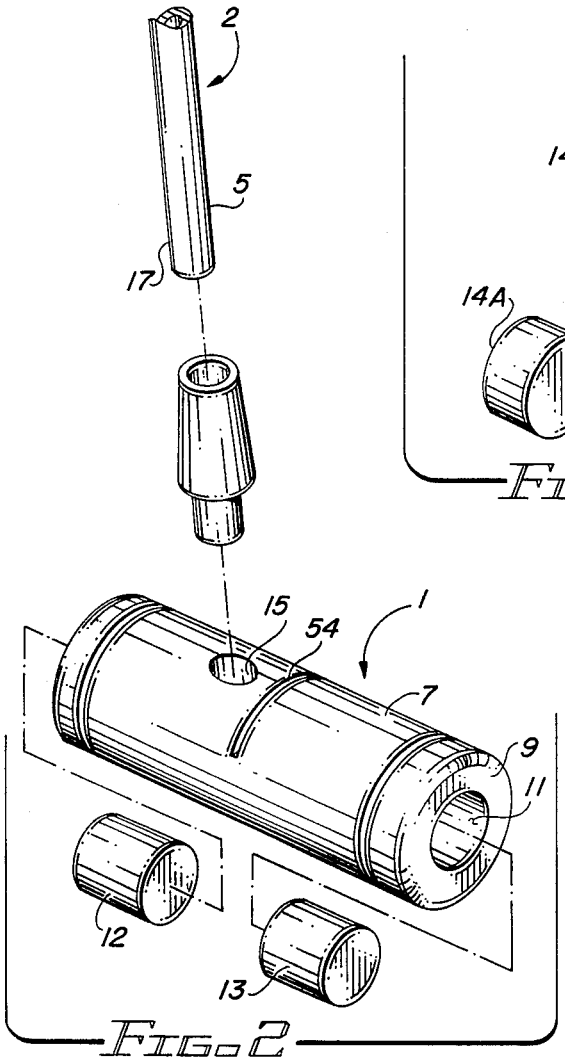
FIG. 2 is an exploded view illustrating the relationship between various components at the club head region of my putter.
Figure 3:
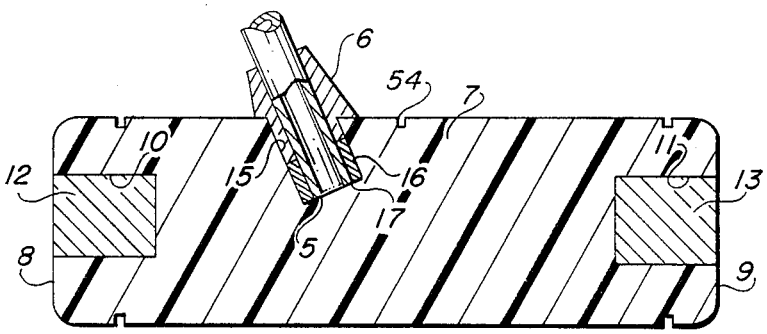
FIG. 3 is a cross sectional view taken along the lines 3—3 of FIG. 1 and illustrating certain of the internal structure of the club head region of my putter.

The structure and relationship of the various components of the generally cylindrical club head 1 may best be appreciated by simultaneous reference to the exploded view of FIG. 2 and to the cross sectional view of FIG. 3. The main body portion 7 of the club head 1 includes a first weight-receiving receptacle 10 recessed in the heel end 8 and a second weight-receiving receptacle 11 recessed in the toe end 9. Inserted respectively within the weight-receiving receptacles 10, 11, are first and second weight inserts 12, 13. The weight inserts 12, 13 are fabricated from a material which has a substantially higher weight-to-volume ratio than the plastic material from which the main body 7 is fabricated.

In one presently preferred embodiment of the invention, the weight inserts 12, 13 are cylindrical brass plugs received within the cylindrical receptacles 10, 11. In this embodiment of the invention, the diameter f the weight inserts 12, 13 is selected to be an interference fit such that they can be permanently pressed into their respective receptacles. Alternatively, weight inserts 12, 13 dimensioned to have slightly more clearance, may be permanently fixed in place using an appropriate adhesive. For some materials suitable for the fabrication of the main body 7, most adhesives will be found to be incompatible such that either a very carefully selected adhesive or, preferably, the interference fit procedure may be employed.

Figure 4:
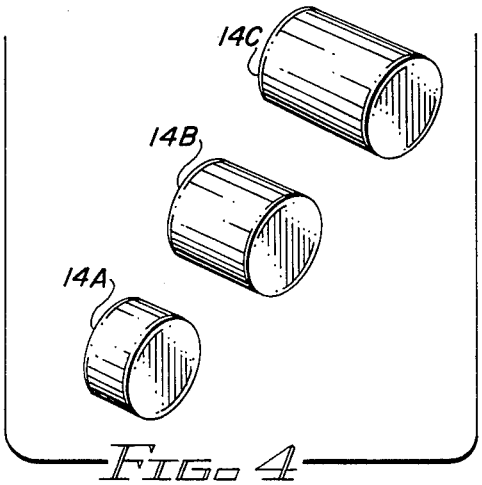
FIG. 4 illustrates exemplary weight components of different mass which may be employed in my putter.

The individual characteristics and preferences of different golfers with respect to the weights 12, 13 may be accommodated by simply selecting the weight from among a series of cylindrical weight inserts, represented as 14*a*, 14*b*, 14*c* in FIG. 4, which have the same diameter but different lengths and therefore different volumes.

The main body 7 is preferably fabricated from a tough, resilient plastic material such as Delrin or Celcon brands of acetal resins (polyoxymethylene, $[CH_2O]_n$. (A discussion of acetal resins may be found in Volume 1, Encyclopedia of Chemical Technology, Third Edition, pp. 112, et seq., by Kirk-Othmer.)) The ball comes off of a putter head made of Delrin or Celcon softer and at a more even pace and holds a truer path of travel than more conventional materials. Optionally, the acetal homopolymer may be reinforced by Teflon and/or glass fibre.

The terminal portion 17 of club head end 5 of the shaft 2, whether or not an optional ferrule 6 is employed, may be fixed within a shaft-end-receiving aperture 15 by a suitable adhesive 16 or by an alternative approach which will be discussed below. The shaft-end-receiving aperture 15 extends from the outer peripheral surface of the main body 7 and terminates at a position within the main body in a fashion which is dictated by the natural requirements of coupling the shaft to the club head. Thus, the club head end 5 of the shaft 2 is affixed to the club head 1 at a position closer to the heel end 34 than to the toe end 35 such that the shaft extends upwardly at an angle (toward the heel end) which is appropriate for the physical characteristics and accommodates the preferences of an individual golfer.

Referring now to the variant embodiment of the subject putter illustrated in FIG. 5, it will be understood that, as an alternative procedure for securing the terminal portion 22 of the shaft end 23 to the main body 24, the aperture 25 may be provided with internal threads to mate with external threads provided on the terminal portion of the shaft. Thus, the shaft and club head may simply be screwed together.

Similarly, in the embodiment of the invention illustrated in FIG. 5, weight inserts 26, 27 may be selectively incorporated at the heel and toe ends of the club head 21 to accommodate the characteristics and preferences of a given golfer. Thus, weight inserts 26, 27 having threaded outer surfaces 28 (FIG. 6) may be introduced into correspondingly threaded weight-receiving receptacles 29, 30 such that their outer ends 31, 32 are flush with the heel and toe ends 33, 34 of the main body. In order to accommodate weight inserts of different lengths and therefore different masses, lightweight plastic spacers 35, 35 (and also 37 in FIG. 6) of appropriate dimensions may first be introduced into the receptacles 29, 30. The spacers 35, 36 may be fabricated from the same material as the main body 24 or another lightweight material of suitable characteristics.

Referring to FIGS. 6 and 7, it may be noted that coupling to the weight inserts to facilitate applying screwing or unscrewing torque to them may be achieved by such expedients as a transverse slot 38, an Allen head receptacle 39 or a specially keyed receptable of diverse shape. If transverse slot 38 is employed, a large screwdriver, the end of a coin or the like may be used as a tool to replace the weight inserts. If specially shaped receptacles in the outboard ends of the weight inserts are provided, a complementarily shaped tool must be used to change the weight inserts. This arrangement may be beneficial in some instances to prevent unauthorized access to the weight inserts.

Referring briefly now to FIG. 10 (which will be discussed in further detail below), it may be noted that the diameter of the generally cylindrical club head 21 is preferably somewhat smaller than that of a regulation golf ball 40. A relationship of these dimensions which as proven to be highly satisfactory, assuming a one and seven-eights inches diameter for a regulation golf ball, is a diameter of one and one-quarter inches for the club head 21.

Attention is now directed to FIG. 9 which illustrates the influence of a conventional putter 41 on a golf ball 42 which is being putted toward a target cup. As the putter 41 moves in the direction indicated by the large arrow 43 during a putting stroke, it engages the ball 42 at a position 44 which is essentially in horizontal alignment with the center of the ball 42. As a result, as indicated by the arrow 45, the initial travel of the ball 42 is characterized by a sliding, rather than rolling, traverse across the surface of the green 46. The detrimental effects of this action have been previously discussed.

Referring again to FIG. 10, consider now the very different initial ball action obtained by the use of the subject putter as it passes through successive positions during the putting stroke as indicated by (a) phantom position 47 (prior to contact with the ball 40), (b) phantom position 48 (at the instant of first contact with the ball 40 when the ball itself was at its initial position as also indicated in phantom at 48), (c) as shown in solid (a position obtained shortly after the club head 21 has first engaged the ball 40 but is still in rolling engagement with it), (d) phantom position 49 (approximately at the end of engagement between the club head 21 and the ball 40) and (e) phantom position 50 (which is part of the follow-through stroke with the ball well on its way as indicated at 40*b*). When the ball is correctly stroked, the initial impact (as shown in phantom at 48) is slightly below a horizontal line passing through the center of the ball, a condition obtained because of the difference of diameters between the club head 21 of the putter and the regulation ball 40. As the stroke continues, the cylindrical surface of the club head 21 remains in rolling engagement with the outer surface of the ball 40 for a substantial stroke arc which continues at least from the phantom position at 48 through the release position approximately at phantom position 49. As a result, as indicated by the arrow 51, immediate forward spin is imparted to the ball 40 which therefore follows a more true path across the green surface 46 for the reasons previously discussed. It may be noted that, even if the ball is incorrectly struck too high, the initial spin to the ball is still imparted to a somewhat diminished degree.

Attention is now directed to FIG. 8 which illustrates another advantage of the subject putter. Preferably, in the course of a putting stroke, the ball is struck by the club head 21 of the putter at a lateral position equidistant between the heel end 34 and the toe end 35 of the club head as represented by the ball at phantom position 52. However, consider the action of the putter/ball engagement if a ball is struck eccentrically from this position as represented, for example, by the ball at phantom position 53. With conventional putters, there is a subtle tendency of the club head to pivot about its center line, an effect which slightly, but significantly, alters the initial direction taken by the ball upon impact from that which would otherwise result from the path of the club head at the time of engagement with the ball. However, because of the concentration of the mass of the club head 21 at the heel and toe ends 34, 35 as provided by the incorporation of the weight inserts, this tendency is substantially reduced in the subject putter. It is not, of course, completely eliminated such that it is desirable to provide a visual alignment mark 54 (see also FIGS. 1, 2, 3 and 5) which extends circumferentially partially around the main body 24 of the club head at a position equidistant between the heel and toe ends, of course, proximate the position at which the shaft and club head are joined.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A golf putter comprising:

(A) a generally cylindrical club head, said club head including:

1. a main body portion fabricated from acetal resin, said main body portion having:
   a. a heel end and a toe end;
   b. a first weight-receiving receptacle recessed in said heel end;
   c. a second weight-receiving receptacle recessed in said toe end; and
   d. a shaft-end-receiving aperture extending from an outer periphery surface of said main body portion and terminating at a position within said main body portion;
2. a first weight insert residing in said first weight-receiving receptacle, said first weight insert being characterized as having a higher weight-per-volume ratio than said plastic material; and
3. a second weight insert residing in said second weight-receiving receptacle, said second weight insert being characterized as having a higher weight-per-volume ratio than said plastic material;

(B) a shaft including:

1 a grip end;
2. an elongated intermediate section; and
3. a club head end, said club head end having a terminal portion dimensioned and configured to be closely received within said shaft-end-receiving aperture; and (C) joining means for securely fixing said terminal portion of said club head end of said shaft in said shaft-end-receiving aperture.

2. The golf putter of claim 1 in which the diameter of said club head is smaller than the diameter of the golf ball to be played.

3. The golf putter of claim 2 in which each of said first and second weight inserts are an interference fit to the respective one of said first and second weight-receiving receptacles.

4. The putter of claim 3 wherein the head has a diameter of about one and one-quarter inches.

5. The golf putter of claim 3 in which each of said first and second weight inserts is fabricated from the same material and has the same dimensions.

6. The putter of claim 5 wherein the head has a diameter of about one and one-quarter inches.

1. each of said weight-receiving receptacles is generally cylindrical and has the walls thereof internally threaded; and
2. each of said weight inserts is generally cylindrical and is externally threaded to threadedly engage one of said weight-receiving receptacles.

7. The golf putter of claim 2 in which:

1. each of said weight-receiving receptacles is generally cylindrical and has the walls thereof internally threaded; and 2. each of said weight inserts is generally cylindrical and is externally threaded to threadedly engage one of said weight-receiving receptacles.

8. The putter of claim 7 which further includes at least third and fourth weight inserts which are different in weight from said first and second weight inserts.

9. The putter of claim 7 wherein the head has a diameter of about one and one-quarter inches.

10. The putter of claim 2 which further includes a visual alignment mark extending circumferentially partially around said main body at a position equidistant between said heel and toe ends and proximate said shaft-end-receiving aperture.

11. The putter of claim 2 wherein the head has a diameter of about one and one-quarter inches.

12. The golf putter of claim 1 in which each of said first and second weight inserts are an interference fit to the respective one of said first and second weight-receiving receptacles.

13. The golf putter of claim 12 in which each of said first and second weight inserts is fabricated from the same material and has the same dimensions.

14. The putter of claim 13 wherein the head has a diameter of about one and one-quarter inches.

15. The putter of claim 12 wherein the head has a diameter of about one and one-quarter inches.

16. The golf putter of claim 1 in which:

17. The putter of claim 6 which further includes at least third and fourth weight inserts which are different in weight from said first and second weight inserts.

18. The putter of claim 17 wherein the head has a diameter of about one and one-quarter inches.

19. The putter of claim 6 wherein the head has a diameter of about one and one-quarter inches.

20. The putter of claim 1 which further includes a visual alignment mark extending circumferentially partially around said main body at a position equidistant between said heel and toe ends and proximate said shaft-end-receiving aperture.

* * * * *

UNITED STATES PATENT AND TRADEMARK OFFICE

CERTIFICATE OF CORRECTION

PATENT NO. : 4,872,684

DATED : October 10, 1989

INVENTOR(S) : Stephanie A. Dippel

It is certified that error appears in the above-identified patent and that said Letters Patent is hereby corrected as shown below:

In claim 6, column 6, lines 59-64, the following is deleted:

"1. each of said weight-receiving receptacles is generally cylindrical and has the walls thereof internally threaded; and 2. each of said weight inserts is generally cylindrical and is externally threaded to threadedly engage one of said weight-receiving receptacles."

In claim 16, the following words have been inserted between lines 8 and 9 of column 8.

"1. each of said weight-receiving receptacles is generally cylindrical and has the walls thereof internally threaded; and 2. each of said weight inserts is generally cylindrical and is externally threaded to threadedly engage one of said weight-receiving receptacles."

In claim 17, column 8, line 9, "6" is changed to ---16---.

In claim 19, column 8, line 14, "6" is changed to ---16---.

Signed and Sealed this

Second Day of April, 1991

*Attest:*

*Attesting Officer*

HARRY F. MANBECK, JR.

*Commissioner of Patents and Trademarks*